US005186283A

United States Patent [19]

Salmon

[11] Patent Number: 5,186,283

[45] Date of Patent: Feb. 16, 1993

[54] TRIPLE-WRAP TRACTION ARRANGEMENT

[75] Inventor: John K. Salmon, South Windsor, Conn.

[73] Assignee: Otis Elevator Company, Farmington, Conn.

[21] Appl. No.: 765,852

[22] Filed: Sep. 26, 1991

[51] Int. Cl.[5] ..... B66B 11/08

[52] U.S. Cl. ..... 187/20; 242/47.01; 254/271; 254/333

[58] Field of Search ..... 187/20, 23, 27; 254/271, 333, 334, 338; 242/47.01, 47.08, 47.09, 47.12

[56] References Cited

U.S. PATENT DOCUMENTS 3,664,205 5/1972 Luras ..... 254/334
3,707,275 12/1972 Arnold ..... 242/47.01 X
3,854,698 12/1974 Ferrentino ..... 242/47.01 X
4,448,394 5/1984 LeMoine ..... 254/271
4,753,322 6/1988 Yasuda ..... 187/20

FOREIGN PATENT DOCUMENTS 1174030 7/1964 Fed. Rep. of Germany .

*Primary Examiner*—Robert P. Olszewski
*Assistant Examiner*—Dean A. Reichard
*Attorney, Agent, or Firm*—Lloyd D. Doigan; Richard D. Getz

[57] ABSTRACT

An elevator roped in a triple-wrap configuration has a deflector located near a "pay-on" position to urge the rope to move from one side of a sheave groove to the other side of the groove to minimize the probability that adjacent wraps of the rope contact each other. The deflector may be a fixed comb or a rotatable wheel.

2 Claims, 2 Drawing Sheets

TRIPLE-WRAP TRACTION ARRANGEMENT

TECHNICAL FIELD

This invention relates to a rope and drive sheave arrangement for a traction elevator.

BACKGROUND ART

Generally, an elevator car is supported by a wire rope which attaches at a first end to an elevator car, passes over a drive sheave, and attaches at the other end to a counterweight. The car is raised or lowered via a traction force developed between the wire rope and the drive sheave.

Generally, the rope is disposed on a drive sheave in one of three ways. One way, generally used in low-speed applications (i.e., low-rise buildings), utilizes a "single-wrap" in which the rope contacts about 180° of a groove within the periphery of the drive sheave. To improve the traction between the rope and the groove, the groove is often shaped, e.g. with a V-cut or undercut, or provided with a plastic insert.

A second way, used in higher-speed applications (i.e., high-rise buildings), utilizes a "double-wrap" in which the rope contacts approximately 90°-180° of first and second parallel grooves provided within the periphery of the drive sheave for increased traction. After one wrap of from 90°-180° in the first groove, an idler sheave displaces the rope for a second wrap (180° ) in the second groove.

The third way utilizes a "triple-wrap" arrangement. Such an arrangement is shown in U.S. Pat. No. 4,753,322 to Yasuda and is owned by the assignee herein. The reference to Yasuda is hereby incorporated by reference herein. According to Yasuda, the rope is helically wrapped for at least 360° within a groove disposed in the periphery of the drive sheave. The groove has a width of at least twice the diameter of the rope, and a depth of less than half the diameter of the rope to minimize friction between the rope and the edges of the groove. The groove has a flat bottom to facilitate the rope's movement from one side of the groove to the other as the sheave drives the rope.

Ideally, the rope is helically wrapped around 540° of the sheave within the groove. During rotation of the sheave, the rope enters one side portion of the groove at a "pay-on" point, wraps 180° on the one side of the groove over an upper half of the sheave, continues to wrap another 180° around the lower half of the sheave, continues to wrap 180° on the other side portion of the groove over the upper half of the sheave and exits from the groove at a "pay-off" point. The rope, at the pay-on point tends to push the second wrap towards the other side of the groove.

DISCLOSURE OF THE INVENTION

It is an object of the invention to minimize contact between adjacent segments of the rope in a triple-wrap traction device.

According to the invention, an elevator roped in a triple-wrap configuration has a deflector located near a "pay-on" position to urge the rope to move from one side of a sheave groove to the other side of the groove to minimize the probability that adjacent wraps of the rope contact each other.

According to a feature of the invention, the deflector provided is a fixed comb.

According to another feature of the invention, the deflector is comprised of a rotatable disk which minimizes frictional contact with the rope.

According to another feature of the invention the deflector is movable relative to the sheave so that if the deflector moves, a dangerous condition signal is sent to stop the sheave.

These and other objects, features, and advantages of the present invention will become more apparent in light of the detailed description of a best mode embodiment thereof, as illustrated in the accompanying drawings.

BEST MODE FOR CARRYING OUT THE INVENTION

Figure 1:
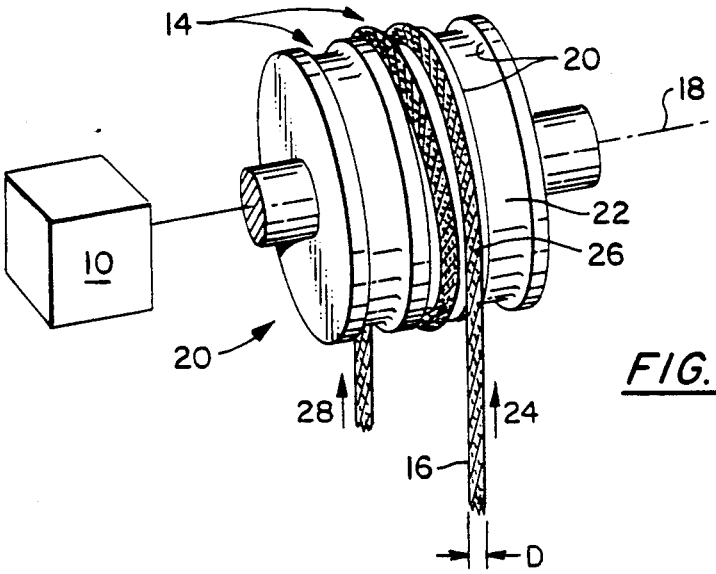
FIG. 1 is a perspective view of a sheave having a rope wrapped thereon in accordance with the present invention.

Referring to FIG. 1, a motor 10 provides rotative power to a drive sheave 12 having a plurality of grooves 14 for receiving a rope 16 therein is shown.

The rope 16 connects at one end to a cab (not shown) and at an other end to a counterweight (not shown) as is known in the art. The rope is constructed of a multiplicity of steel strands and has a diameter D. When the sheave 12 is driven about a drive axis 18 by motor 10, traction between the rope and the sheave induces the cab and the counterweight to move.

As is known in the art, each groove 14 has width slightly more than twice the rope diameter so that a gap is created between juxtaposed segments of the rope 18 thereby avoiding friction therebetween as the sheave 12 drives the rope 16. Each groove has a depth that is less than half the diameter D of each rope to prevent the sides of the groove from abrading the rope as the rope passes on and off the sheave. Axially spaced apart side portions 20 of each groove have a cross-sectional arc of about 90° conforming generally to the circumferential portion of the rope and contact from the sides of the groove. Each groove has a flat bottom portion 22 connecting each side portion. The bottom is flat because the rope must cross over helically from one side of the groove to the other side as the sheave rotates. A concave-shaped bottom would cause adjacent wraps of rope in the groove to migrate toward and abrade each other. A convex-shaped bottom would inhibit the rope from crossing from one side to the other causing the rope to wrap upon itself as the sheave is driven. The number of grooves correspond to the number of ropes required to support the cab and the counterweight (not shown).

Figure 2:
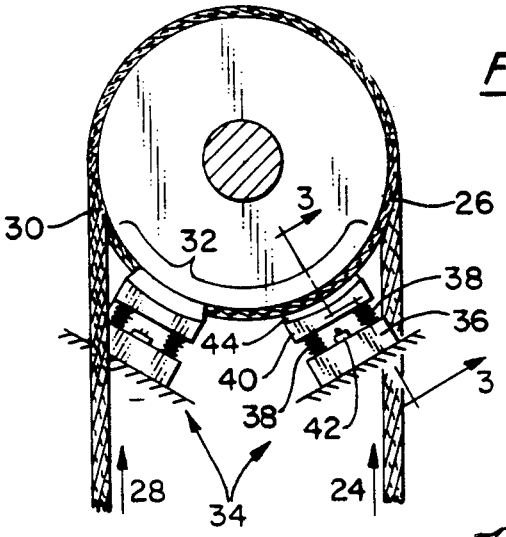
FIG. 2 is a view of the drive sheave of FIG. 1 as seen from the direction A.
Figure 4:
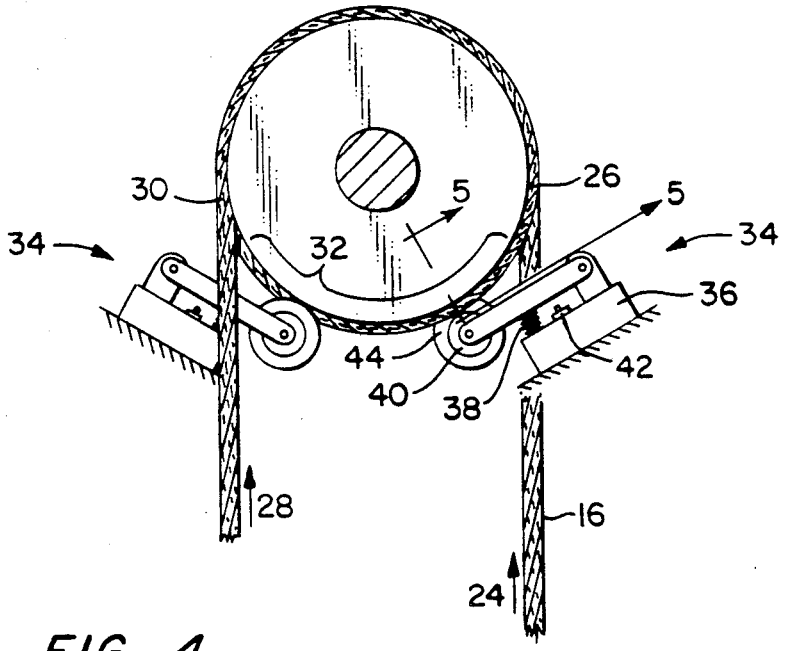
FIG. 4 is a view of the first embodiment of the drive sheave arrangement of the invention.

Referring to FIGS. 2 and 4, as the sheave rotates in a first direction 24 to raise the cab, the rope 16 contacts one side portion 20 of the groove 14 at a first "pay on" point 26. As the sheave rotates in a second direction 28 to lower the cab, the rope contacts the other side portion of the groove at a second "pay on" point 30. As the sheave rotates in the first direction 24 to raise the cab, the rope winds off the side portion of the groove at the second "pay on" point 30 (i.e. or the first "pay off" point). As the sheave rotates in the second direction 28 to lower the cab, the rope winds off the other side portion of the groove at the first "pay on" point 26 (i.e. or the second "pay off" point).

As shown in FIGS. 2 and 4, there is a zone 32 of the groove, from about the first "pay on" point 26 to about the second "pay on" point 30 in which there is a single wrap of the rope. The zone does not extend exactly from the first to second pay on point because of the diameter of the rope. In the zone, the single wrap of rope slides axially and helically from one side of the groove to the other.

A deflector 34 is placed in the zone 32 before each "pay on" point to induce axial motion of the rope from one side of the groove to the other. The deflector is placed so that the rope is urged axially across the groove to avoid contacting the portion of the rope wrapping on the sheave 12 at each pay on point 26, 30.

Figure 3:
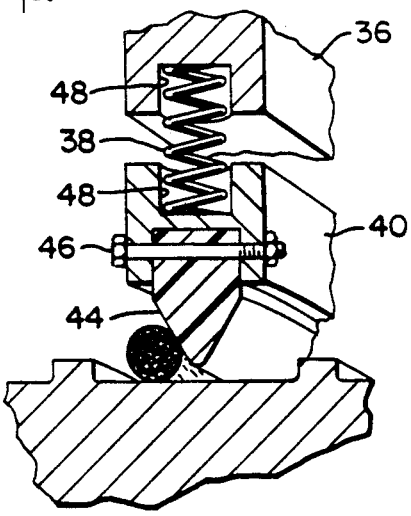
FIG. 3 is a view of the drive sheave of FIG. 1 as shown from the direction B.

Referring to FIGS. 2 and 3, a first embodiment of the invention is shown. The deflector 34 comprises a stationary base 36, a pair of springs 38, a holder 40, a sensor 42, and a comb 44. The holder 40 and the base 36 each have a pair of cylindrical openings 48 which act as seats for springs 38. The sensor 42, which comprises a conventional proximity sensor, or switch, or the like, is mounted between the holder 40 and the springs 38. The comb 44, which may be constructed of any low friction, low wear, self lubricating material, such as nylon, is connected to the holder 40 by conventional means such as bolts 46 (see FIG. 3). The deflector may be cocked at an angle relative to the side walls of the groove to urge the rope in the zone towards the other side wall.

If the comb 44 is forced away from the sheave for any reason, such as a snag in the rope or the rope jumps the sheave groove or the rope lays up upon itself or other similar emergency condition, the holder will move toward the sensor which then sends a signal to a computer (not shown) to stop the motor 10.

Figure 5:
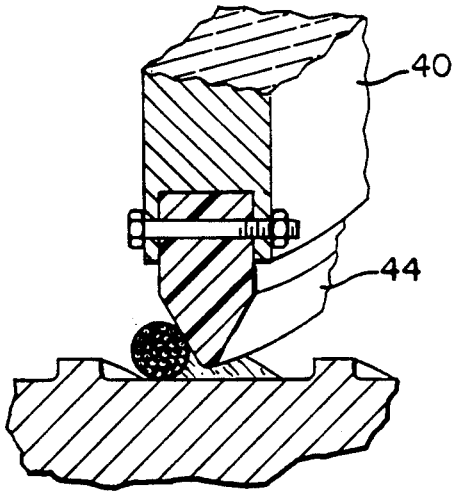
FIG. 5 is a second embodiment of the drive sheave of the invention.

Referring to FIGS. 4 and 5, a second embodiment of the invention is shown. As with the embodiment shown in FIGS. 2 and 3, the deflector 34 comprises a stationary base 36, a spring 38, a holder 40, a sensor 42, and a comb 44. However, the comb is ring-shaped and the holder is disk-shaped. The comb, which is ring shaped, is bonded to the holder by conventional means and is constructed of a similar material. The holder is mounted for rotation at one end of an arm 50. The other end of the arm is rotatably attached to the base. The spring is seated within cylindrical opening 52 in the base and urges the arm and comb to move towards and the sheave.

The sensor of FIG. 5, which also comprises a conventional proximity sensor, or switch, or the like, is mounted between the arm and the base. As above, if the comb is forced away from the sheave for any reason, the arm will move toward the sensor which then sends a signal to a computer (not shown) to stop the motor. As above, the deflector may be cocked at an angle relative to the side walls of the groove to urge the rope in the zone towards the other side wall.

Although the invention has been shown and described with respect to a best mode embodiment thereof, it should be understood by those skilled in the art that various other changes, omissions, and additions in the form and detail thereof may be made therein without departing from the spirit and scope of the invention.

I claim:

1. An elevator having a sheave having a groove for receiving greater than a 360° wrap of rope therein, the rope winding on the groove at a pay-on point adjacent one side portion thereof, moving axially across said groove, and winding off said groove adjacent a second side portion thereof characterized by:

a deflector disposed between said pay on point and said pay off point for urging said rope to move axially from said one side of said groove to said other side of the groove thereby minimizing the probability that adjacent wraps of rope in said groove contact each other; and means for detecting motion of said deflector away from said groove to determine whether said elevator is experiencing an emergency condition.

2. An elevator having a sheave having a groove for receiving greater than a 360° wrap of rope therein, the rope winding on the groove at a pay-on point adjacent one side portion thereof, moving axially across said groove, and winding off said groove adjacent a second side portion thereof characterized by:

a deflector disposed between said pay on point and said pay off point for urging said rope to move axially from said one side of said groove to said other side of the groove thereby minimizing the probability that adjacent wraps of rope in said groove contact each other;

means for moving said deflector away from said sheave if an emergency condition exists; and means for detecting motion of said deflector away from said groove to determine whether said elevator is experiencing an emergency condition.

* * * * *